US006716007B2

(12) United States Patent
Kim et al.

(10) Patent No.: US 6,716,007 B2
(45) Date of Patent: Apr. 6, 2004

(54) VARIABLE CAPACITY ROTARY COMPRESSOR

(75) Inventors: Hyun-Joong Kim, Suwon (KR); In-Ju Lee, Yongin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/309,134

(22) Filed: Dec. 4, 2002

(65) Prior Publication Data

US 2004/0009083 A1 Jan. 15, 2004

(30) Foreign Application Priority Data

Jul. 9, 2002 (KR) ..... 2002-39841

(51) Int. Cl.[7] ..... F04C 18/356; F04C 29/10

(52) U.S. Cl. ..... 418/23; 418/26; 418/27; 418/63

(58) Field of Search ..... 418/23–27, 63

(56) References Cited

U.S. PATENT DOCUMENTS 4,397,618 A * 8/1983 Stenzel ..... 418/23
5,131,826 A * 7/1992 Boussicault ..... 418/23
5,871,342 A 2/1999 Harte et al. ..... 418/23

FOREIGN PATENT DOCUMENTS

| | | | | |
|---|---|---|---|---|
| DE | 214899 | * 10/1984 | ..... | 418/23 |
| JP | 55-91789 | * 7/1980 | ..... | 418/23 |
| JP | 57-41492 | * 3/1982 | ..... | 418/23 |
| JP | 1-247786 | * 10/1989 | ..... | 418/23 |

* cited by examiner

*Primary Examiner*—John J. Vrablik
(74) *Attorney, Agent, or Firm*—Staas & Halsey LLP

(57) ABSTRACT

A variable capacity rotary compressor includes a housing having a cylindrical compressing chamber defined therein, a rotating shaft having an eccentric body part which rotates in the compressing chamber, a ring piston fitted over the eccentric body part of the rotating shaft so as to have the ring piston rotate while being in contact with an inner surface of the compressing chamber, a vane mounted in the housing so as to have the vane advance or retract in a radial direction of the compressing chamber in accordance with a rotation of the ring piston, and a control unit which is connected to the vane and moves in opposite directions in response to pressures of a refrigerant inlet and a refrigerant outlet of the compressor, so as to control a moving range of the vane. Accordingly, a simpler construction of the compressor is achieved and a refrigerant compressing capacity is easily controlled.

18 Claims, 4 Drawing Sheets

VARIABLE CAPACITY ROTARY COMPRESSOR

CROSS-REFERENCE TO RELATED APPLICATIONS

This application claims the benefit of Korean Patent Application No. 2002-39841 filed on Jul. 9, 2002, in the Korean Intellectual Property Office, the disclosure of which is incorporated herein by reference.

BACKGROUND OF THE INVENTION

1. Field of the Invention

The present invention relates to rotary compressors for refrigeration systems, and more particularly, to a variable capacity rotary compressor having a variable compressing capacity.

2. Description of the Related Art

Generally, refrigerating systems, such as air conditioners or refrigerators, use variable capacity rotary compressors, a refrigerant compressing capacity of which is varied as desired to vary the refrigerating capacity of the systems.

FIG. 1 shows a sectional view of a conventional variable capacity rotary compressor disclosed in U.S. Pat. No. 5,871,342. As shown in FIG. 1, the conventional variable capacity rotary compressor comprises a housing 1, with a cylindrical compressing chamber 2 defined in the housing 1 and a ring piston 3 installed in the cylindrical compressing chamber 2 so as to have the ring piston 3 eccentrically rotate in the cylindrical compressing chamber 2. A plurality of outer vanes 4 are slidably mounted in the housing 1 so as to have the outer vanes 4 be retractable in radial directions while being in contact with the outer surface of the ring piston 3. That is, the outer vanes 4 divide the cylindrical compressing chamber 2 of the housing 1 into a plurality of variable gas chambers 2*a* and 2*b*.

A plurality of vane deactivation assemblies 5 are installed on the housing 1 at corresponding positions adjacent to the outer vanes 4 to deactivate the outer vanes 4 or release the outer vanes 4 from a deactivated state. Each of the vane deactivation assemblies 5 includes a deactivation pin 5*b* which engages a deactivation recess 4*a* in its respective outer vane 4 in response to a corresponding one or both solenoid actuators 5*a* being energized. The deactivation pins 5*b* hold the outer vanes 4 in a retracted position out of contact with the ring piston 3, thus deactivating the outer vanes 4 and reducing the capacity of the variable capacity rotary compressor. The variable capacity of the variable capacity rotary compressor is thus accomplished.

However, the above variable capacity rotary compressor is problematic in that the vane deactivation assemblies 5 have a complex construction. That is, the vane deactivation assemblies 5 are designed such that the deactivation pins 5*b* of the deactivation assemblies 5 selectively deactivate the outer vanes 4 while advancing or retracting in radial directions by the solenoid actuators 5*a* installed on the housing 1. Due to such a complex construction, producing the above variable capacity rotary compressor is difficult and the production cost of the variable capacity rotary compressor is high.

SUMMARY OF THE INVENTION

Accordingly, an aspect of the present invention is to provide a variable capacity rotary compressor which has a simple construction, easily varies its refrigerant compressing capacity, as desired, and is easy to produce at a low production cost.

To achieve the above and/or other aspects of the present invention, there is provided a variable capacity rotary compressor, comprising a housing having a cylindrical compressing chamber defined in the housing, a rotating shaft having an eccentric body part which rotates in the compressing chamber of the housing, a ring piston which is fitted over the eccentric body part of the rotating shaft and rotates while being in contact with an inner surface of the compressing chamber a vane which is mounted in the housing and advances or retracts in a radial direction of the compressing chamber in accordance with a rotation of the ring piston, and a control unit which is connected to the vane and controls a moving range of the vane by moving in opposite directions in response to pressures of a refrigerant inlet and a refrigerant outlet of the compressor.

The control unit may comprise a control cylinder having a control piston and mounted outside the housing, wherein the control piston is set in the control cylinder so as to advance and retract in the same direction as a moving direction of the vane, a connecting member which connects the vane to the control piston so as to push or pull the vane in response to a movement of the control piston, a first control path which communicates with an interior of the control cylinder, a second control path which allows the first control path to communicate with the refrigerant outlet of the compressor, a third control path which allows the first control path to communicate with the refrigerant inlet of the compressor, and a path control valve installed at a confluence of the first, second and third control paths.

The path control valve may be a three-way valve which selectively allows the first control path to communicate with one of the second and third control paths.

In the rotary compressor, the vane may come into contact at an end thereof with a portion of an outer surface of the ring piston at which a radius of a rotation of the ring piston is at a maximum, in response to the first control path communicating with the second control path and allowing the pressure of the refrigerant outlet of the compressor to act on the control piston. The vane may be spaced apart from the portion of the outer surface of the ring piston at which the radius of the rotation of the ring piston is at a minimum, in response to the first control path communicating with the third control path and allowing the pressure of the refrigerant inlet of the compressor to act on the control piston.

The control unit may further comprise a first spring which normally biases the vane toward the ring piston, and a second spring which normally biases the ring piston in a direction opposite to a direction in which the first spring biases the vane. The second spring may have a higher elasticity than that of the first spring.

The variable capacity rotary compressor may further comprise a hermetic casing, wherein the housing is set in the hermetic casing, the control piston is set in the control cylinder, which is mounted to an outer surface of the hermetic casing, and the connecting member penetrates the hermetic casing so as to connect the vane to the control piston.

BRIEF DESCRIPTION OF THE DRAWINGS

The above aspects and advantages of the present invention will become more apparent by describing in detail a preferred embodiment thereof with references to the accompanying drawings in which.

DETAILED DESCRIPTION OF THE PREFERRED EMBODIMENTS

Figure 1:
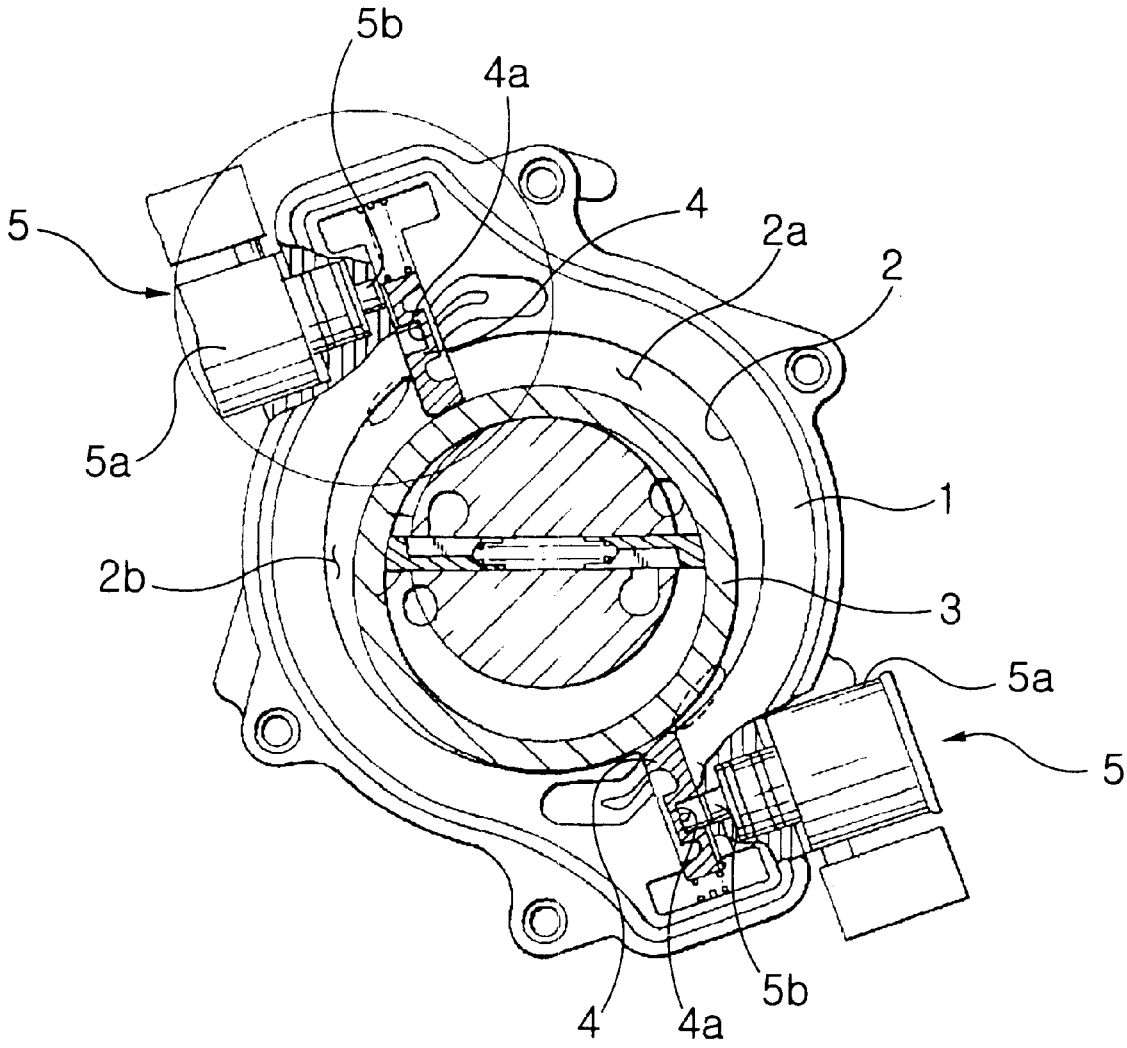
FIG. 1 ( Prior Art )
FIG. 1 is a transverse sectional view of a conventional variable capacity rotary compressor.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures.

Figure 2:
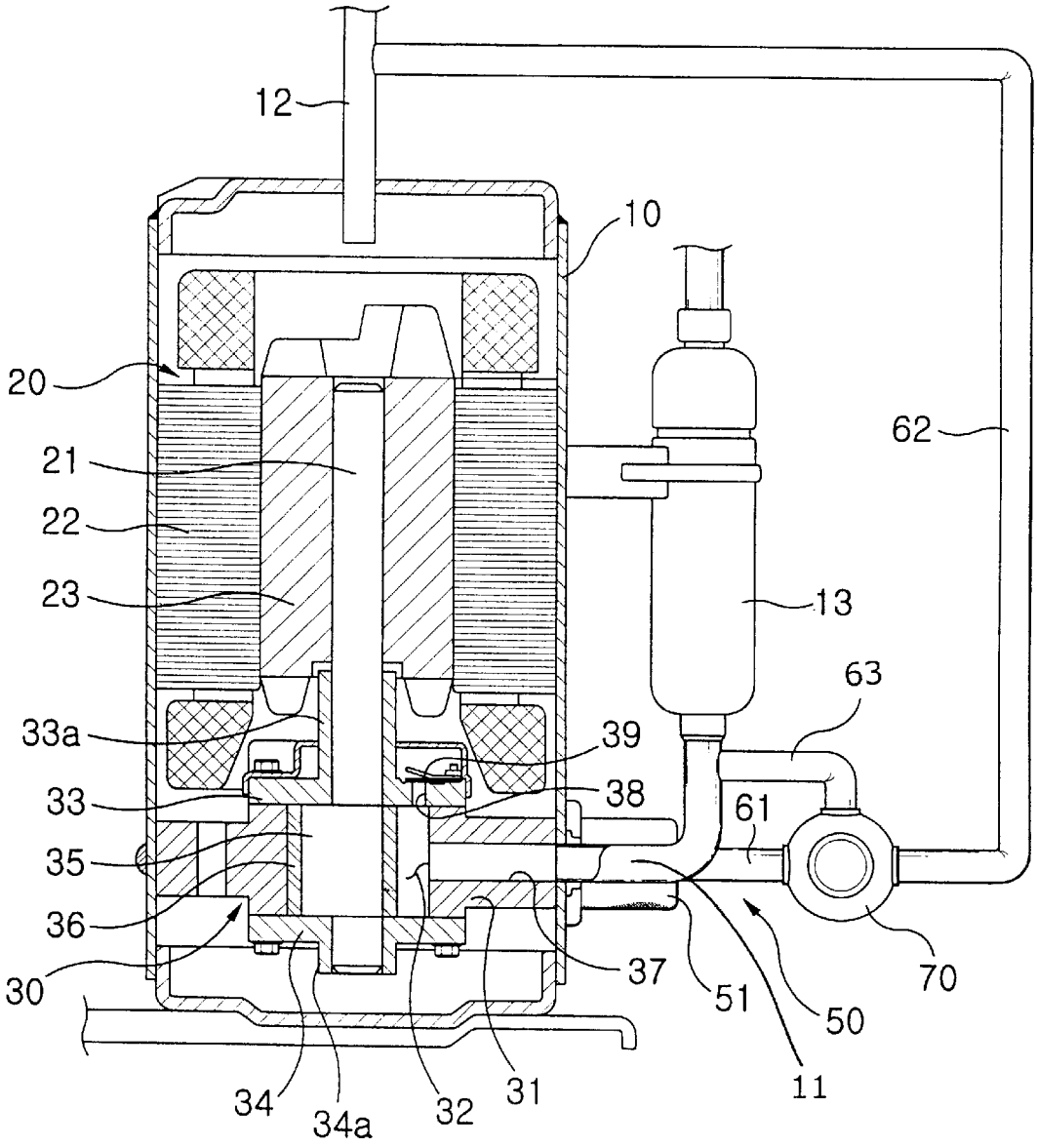
FIG. 2 is a longitudinal sectional view of a variable capacity rotary compressor according to an embodiment of the present invention.
Figure 3:
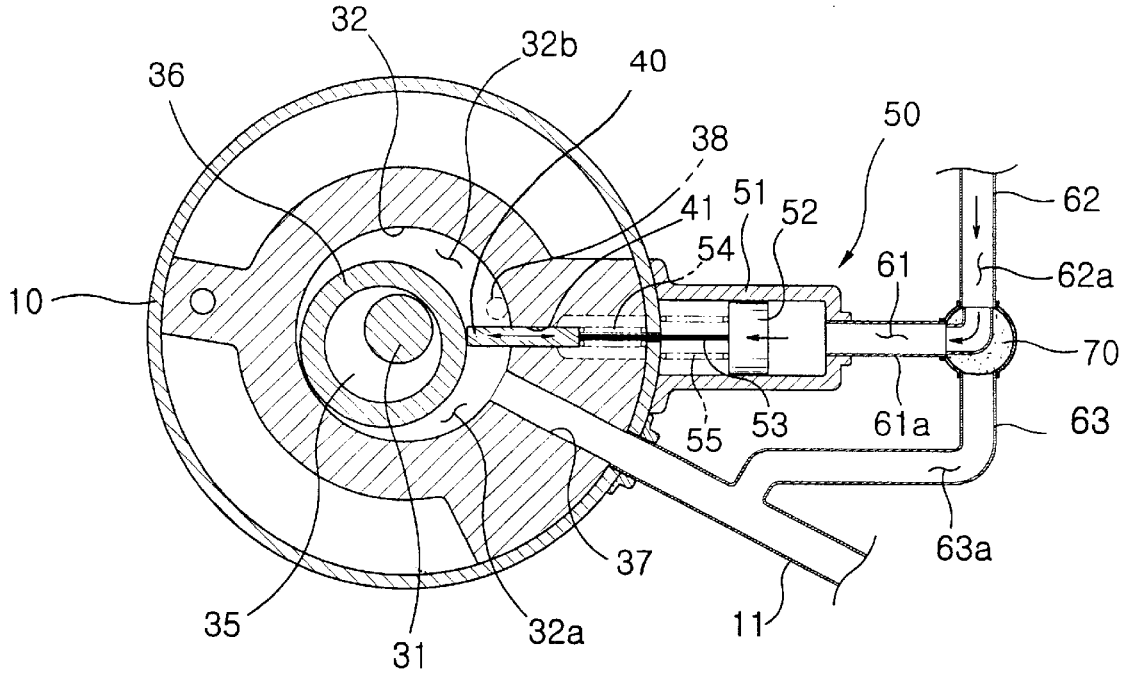
FIG. 3 is a transverse sectional view of the variable capacity rotary compressor shown in FIG. 2, wherein the variable capacity rotary compressor is regulated to have an increased compressing capacity.
Figure 4:
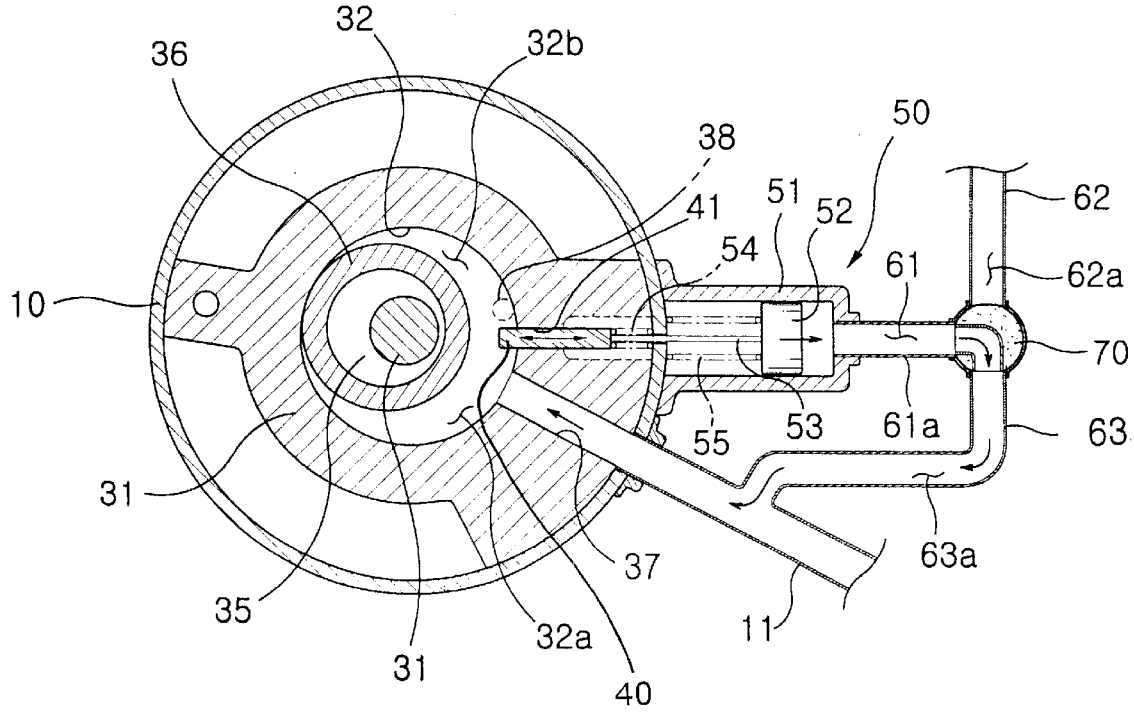
FIG. 4 is a transverse sectional view of the variable capacity rotary compressor shown in FIG. 2, wherein the variable capacity rotary compressor is regulated to have a reduced compressing capacity.

FIGS. 2 through 4 show a variable capacity rotary compressor ("compressor") according to an embodiment of the present invention. As shown in FIG. 2, the compressor comprises a hermetic casing 10 having a drive unit 20 and a compressing unit 30 installed in the hermetic casing 10. The drive unit 20 generates a rotating force where an electric current is applied to the drive unit 20. The compressing unit 30 is coupled to the drive unit 20 by means of, for example, a rotating shaft 21.

The drive unit 20 comprises a stator 22 and a rotor 23. The stator 22 is fixed to an inner surface of the hermetic casing 10, while the rotor 23 is rotatably set in the stator 22 and is coupled to the rotating shaft 21 at a center thereof. The compressing unit 30 includes a cylindrical housing 31 which is fixed to the inner surface of the hermetic casing 10, with a cylindrical compressing chamber 32 defined in the cylindrical housing 31. The compressing unit 30 also includes two end flanges 33 and 34. The two end flanges 33 and 34 are respectively mounted to top and bottom ends of the cylindrical housing 31 so as to have the two flanges 33 and 34 close an open top and an open bottom of the compressing chamber 32, and rotatably hold the rotating shaft 21. To rotatably hold the rotating shaft 21, the two flanges 33 and 34 may include bushing parts 33*a* and 34*a*, respectively.

The rotating shaft 21 includes an eccentric body part 35 at a position inside the compressing chamber 32, with a cylindrical ring piston 36 fitted over the eccentric body part 35. That is, the ring piston 36 is eccentrically rotatable in the compressing chamber 32 while being in contact with an inner surface of the compressing chamber 32, during a rotation of the rotating shaft 21.

An intake port 37 is formed in the cylindrical housing 31 at a predetermined position so as to have the intake port 37 communicate with the compressing chamber 32. A refrigerant intake pipe 11 is connected to the intake port 37, and guides a low-temperature and low-pressure refrigerant from an evaporator (not shown) of a refrigeration system into the intake port 37. A reference numeral 13 denotes an accumulator which is mounted to an intermediate portion of the refrigerant intake pipe 11.

A first end flange 33, which is mounted to the top end of the housing 31, has an exhaust port 38, through which the compressing chamber 32 communicates with the interior of the hermetic casing 10. An exhaust valve 39 is installed at an outside end of the exhaust port 38. A refrigerant outlet pipe 12 is connected to a top end of hermetic casing 10 so as to guide the compressed refrigerant from the hermetic casing 10 to a condenser (not shown) of the refrigeration system.

As shown in FIG. 3, a vane 40 is slidably mounted in the cylindrical housing 31 and moves in a radial direction of the ring piston 36 in accordance with an eccentric rotation of the ring piston 36 within the compressing chamber 32, thus dividing the compressing chamber 32 into a variable suction chamber 32*a* which communicates with the intake port 37 and a variable exhaust chamber 32*b* which communicates with the exhaust port 38. To slidably hold the vane 40, the housing 31 may have a vane-receiving slot 41.

In the compressor having the above-mentioned construction, the ring piston 36 is eccentrically rotated in the compressing chamber 32 along with the eccentric body part 35 of the rotating shaft 21. During such an eccentric rotation of the ring piston 36 within the compressing chamber 32, the ring piston 36 sucks a refrigerant from the intake port 37, and compresses the refrigerant, prior to discharging the compressed refrigerant into the interior of the hermetic casing 10 through the exhaust port 38.

The compressor of the present invention further comprises a vane control unit 50, which controls a radial moving range of the vane 40 by using a refrigerant's pressure difference between the intake port 37 and the exhaust port 38, thus controlling a refrigerant compressing capacity of the compressor.

The vane control unit 50 comprises a control cylinder 51 which is mounted to an outer surface of the hermetic casing 10 at a position around the vane 40. A control piston 52 is slidably set in the control cylinder 51 so as to have the control piston 52 be axially movable in the control cylinder 51. A connecting member 53 connects the vane 40 to the control piston 52, thus pushing or pulling the vane 40 in response to a movement of the control piston 52. The connecting member 53 is penetrated into the hermetic casing 10. A first spring 54 having a predetermined elasticity is installed in the cylindrical housing 31 inside the hermetic casing 10 to normally bias the vane 40 toward the ring piston 36. A second spring 55 is installed in the control cylinder 51 outside the hermetic casing 10 so as to have the second spring 55 normally bias the control piston 52 in a direction opposite to the direction in which the first spring 54 normally biases the vane 40.

The vane control unit 50 further comprises a first control pipe 61, a second control pipe 62, and a third control pipe 63. The first control pipe 61 is connected to the control cylinder 51 and defines a first control path 61*a* which communicates with the interior of the control cylinder 51. The second control pipe 62 branches from the refrigerant outlet pipe 12 (see FIG. 2) and is connected to the first control pipe 61, and defines a second control path 62*a* through which the first control path 61*a* selectively communicates with the refrigerant outlet pipe 12. The third control pipe 63 branches from the refrigerant intake pipe 11 and is connected to a confluence of the first and second control pipes 61 and 62, and defines a third control path 63*a* through which the first control path 61*a* selectively communicates with the refrigerant intake pipe 11. A path control valve 70 is installed at the confluence of the first, second and third control pipes 61, 62 and 63 so as to allow the first control path 61*a* to selectively communicate with one of the second and third control paths 62*a* and 63*a*. The path control value 70 may be, for example, a three-way valve which is operated in response to an electric signal.

The vane control unit 50 having the above-mentioned construction is operated as follows. Where the first and second control paths 61*a* and 62*a* communicate with each other by an operation of the path control valve 70, high pressure of an outlet refrigerant flowing in the refrigerant outlet pipe 12 acts on the control piston 52. In such a case, the control piston 52 is biased toward the vane 40 due to the high pressure of the outlet refrigerant, thus pushing the vane 40 toward the ring piston 36. Where the first and third control paths 61*a* and 63*a* communicate with each other by an operation of the path control valve 70, low pressure of an inlet refrigerant flowing in the refrigerant intake pipe 11 acts on the control piston 52. In such a case, the control piston 52 is biased in a direction opposite to the vane 40 due to the low pressure of the inlet refrigerant, thus spacing the vane 40 from a portion of an outer surface of the ring piston 36, at which the radius of a rotation of the ring piston 36 is at a minimum, by a predetermined gap. The ring piston 36 in the above state performs an idle-rotation within a predetermined range.

To effectively accomplish the above-mentioned operation of the vane control unit 50, the first and second springs 54 and 55 may be provided so as to have an elasticity of the second spring 55 be higher than that of the first spring 54.

An operation and effect of the compressor shown in FIGS. 2 through 4 will be described herein below.

To increase a refrigerant compressing capacity of the compressor, the path control valve 70 is operated to allow the second control path 62*a* to communicate with the first control path 61*a*, as shown in FIG. 3. As the compressor in the above state operates, the rotating shaft 21 is rotated. During the rotation of the rotating shaft 21, the ring piston 36 is eccentrically rotated within the cylindrical compressing chamber 32 by the rotation of the eccentric body part 35 of the rotating shaft 21. In such a case, the vane 40 repeatedly advances toward and retracts from the ring piston 36 in a radial direction of the piston 36. Accordingly, volumes of the variable suction chamber 32*a* and the variable exhaust chamber 32*b* are repeatedly changed by the cooperation of the rotating ring piston 36 and the reciprocating vane 40.

That is, during a rotation of the rotating shaft 21, the volumes of the two variable chambers 32*a* and 32*b* are continuously changed so as to repeatedly reverse the volumes. Thus, the compressing unit 30 sucks a low pressure inlet refrigerant from the intake port 37 into the compressing chamber 32 and compresses the refrigerant, prior to discharging the compressed refrigerant from the compressing chamber 32 into the interior of the hermetic casing 10 through the outlet port 38.

In such a case, since the second control path 62*a* communicates with the first control path 61*a*, a high-pressure outlet refrigerant flowing in the refrigerant outlet pipe 12 is introduced into the control cylinder 51 through the second control path 62*a* and the first control path 61*a*, thus acting on the control piston 52 within the control cylinder 51. Thus, the control piston 52 pushes the vane 40 toward the ring piston 36 since the control piston 52 is connected to the vane 40 through the connecting member 53. Therefore, the vane 40 advances and retracts in the radial direction in response to an eccentric rotation of the ring piston 36, with the end of the vane 40 being in contact with the outer surface of the ring piston 36. The compressor thus accomplishes the maximum refrigerant compressing capacity.

To reduce the refrigerant compressing capacity of the compressor, the third control path 63*a* communicates with the first control path 61*a* by an operation of the path control valve 70, as shown in FIG. 4. In such a case, the second control path 62*a* is closed, while the interior of the control cylinder 51 communicates with the refrigerant intake pipe 11 through the third control path 63*a*. In addition, a restoring force of the second spring 55 is applied to the control piston 52 to move the control piston 52 in a direction opposite to the direction in which the control piston 52 moves in the operation of increasing the refrigerant compressing capacity of the compressor. In such a case, the connecting member 53 pulls the vane 40 and spaces the vane 40 from a portion of the outer surface of the ring piston 36, at which the radius of a rotation of the ring piston 36 is at a minimum, by a predetermined gap. The ring piston 36 in the above state idle-rotates within a predetermined range, and the refrigerant compressing capacity of the compressor is reduced.

As described above, where the vane control unit 50 is controlled to reduce the refrigerant compressing capacity of the compressor, the vane 40 is spaced apart from the portion of the outer surface of the ring piston 36, at which the radius of a rotation of the ring piston 36 is at a minimum. However, the position of the vane 40 in the above state is also included in a range in which the vane 40 can be in contact with a portion of the outer surface of the ring piston 36, at which the radius of a rotation of the ring piston 36 is at a maximum. Therefore, the vane 40 advances and retracts within a short distance only during a time period where the vane 40 comes into contact with the portion of the ring piston 40 at which the radius of the rotation of the ring piston 36 is at the maximum. During one rotation of the ring piston 36, the ring piston 36 idle-rotates within a range at which the vane 40 is spaced apart from the ring piston 36. Therefore, within the range at which the vane 40 is spaced from the ring piston 36, the compressor does not compress the refrigerant. But the compressor compresses the refrigerant within the remaining range at which the vane 40 comes into contact with the ring piston 36. The refrigerant compressing capacity of the compressor is thus reduced.

As described above, the present invention provides a variable capacity rotary compressor, in which a moving range of a vane is controlled by a control piston. The control piston moves toward a ring piston or moves away from the ring piston by use of a pressure of an inlet or outlet refrigerant of the compressor. Therefore, the rotary compressor of the present invention has a simple construction, and a refrigerant compressing capacity is easily controlled.

In addition, the vane control unit which controls the moving range of the vane in the rotary compressor of the present invention has a simple construction as compared to a conventional vane deactivation assembly. Accordingly, it is possible to easily produce variable capacity rotary compressors of the present invention at a low cost.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, comprising:

a housing having a cylindrical compressing chamber defined in the housing;

a rotating shaft having an eccentric body part which rotates in the compressing chamber of the housing;

a ring piston which is fitted over the eccentric body part of the rotating shaft and rotates while being in contact with an inner surface of the compressing chamber;

a vane which is mounted in the housing and advances or retracts in a radial direction of the compressing chamber in accordance with a rotation of the ring piston; and a control unit which is connected to the vane and controls a moving range of the vane by moving in opposite directions in response to pressures of a refrigerant inlet and a refrigerant outlet of the compressor, wherein the control unit includes:

a control cylinder having a control piston and mounted outside the housing, wherein the control piston is set in the control cylinder so as to advance and retract in the same direction as a moving direction of the vane;

a connecting member which connects the vane to the control piston so as to push or pull the vane in response to a movement of the control piston;

a first control path which communicates with an interior of the control cylinder;

a second control path which allows the first control path to communicate with the refrigerant outlet of the compressor;

a third control path which allows the first control path to communicate with the refrigerant inlet of the compressor; and a path control valve installed at a confluence of the first, second and third control paths.

2. The variable capacity rotary compressor according to claim 1, further comprising a hermetic casing, wherein:

the housing is set in the hermetic casing, the control piston is set in the control cylinder, which is mounted to an outer surface of the hermetic casing, and the connecting member penetrates the hermetic casing so as to connect the vane to the control piston.

3. The variable capacity rotary compressor according to claim 1, wherein the control unit controls the moving range of the vane according to a pressure difference between the refrigerant inlet and the refrigerant outlet, so as to control a refrigerant compressing capacity of the compressor.

4. The variable capacity rotary compressor according to claim 1, wherein the compressor has a refrigerant compressing capacity which increases in response to the first control path communicating with the second control path.

5. The variable capacity rotary compressor according to claim 1, wherein the compressor has a refrigerant compressing capacity which decreases in response to the first control path communicating with the third control path.

6. The variable capacity rotary compressor according to claim 1, wherein the path control valve is a three-way valve which selectively allows the first control path to communicate with one of the second and third control paths.

7. The variable capacity rotary compressor according to claim 6, wherein the vane comes into contact at an end thereof with a portion of an outer surface of the ring piston at which a radius of a rotation of the ring piston is at a maximum, in response to the first control path communicating with the second control path and allowing the pressure of the refrigerant outlet of the compressor to act on the control piston, and the vane is spaced apart from the portion of the outer surface of the ring piston at which the radius of the rotation of the ring piston is at a minimum, in response to the first control path communicating with the third control path and allowing the pressure of the refrigerant inlet of the compressor to act on the control piston.

8. The variable capacity rotary compressor according to claim 7, wherein the compressor has a refrigerant compressing capacity which increases in response to the first control path communicating with the second control path and decreases in response to the first control path communicating with the third control path.

9. The variable capacity rotary compressor according to claim 1, wherein the control unit further comprises:

a first spring which normally biases the vane toward the ring piston; and a second spring which normally biases the control piston in a direction opposite to a direction in which the first spring biases the vane.

10. The variable capacity rotary compressor according to claim 9, wherein the second spring has a higher elasticity than that of the first spring.

11. The variable capacity rotary compressor according to claim 1, wherein the vane moves in the radial direction of the compressing chamber so as to divide the compressing chamber into a variable suction chamber which communicates with the refrigerant inlet and a variable exhaust chamber which communicates with the refrigerant outlet.

12. The variable capacity rotary compressor according to claim 11, wherein volumes of the variable suction chamber and the variable exhaust chamber repeatedly change in response to a cooperation of the ring piston being rotated and the vane being reciprocated.

13. The variable capacity rotary compressor according to claim 1, wherein the ring piston sucks a refrigerant provided to the refrigerant inlet, compresses the refrigerant and discharges the compressed refrigerant to the refrigerant outlet, in response to the ring piston being eccentrically rotated in the compressing chamber along with the eccentric body part of the rotating shaft.

14. The variable capacity rotary compressor according to claim 13, wherein the control unit controls the moving range of the vane according to a pressure difference of the refrigerant between the refrigerant inlet and the refrigerant outlet, so as to control a refrigerant compressing capacity of the compressor.

15. The variable capacity rotary compressor according to claim 1, further comprising:

a drive unit which is coupled to the rotating shaft and generates a rotating force;

a hermetic casing which receives the housing;

flanges which are mounted on corresponding ends of the housing so as to close an open top and an open bottom of the housing and rotatably hold the rotating shaft;

an exhaust port which is provided to one of the flanges and selectively allows the compressing chamber to communicate with an interior of the hermetic casing;

a refrigerant outlet pipe which is connected to the refrigerant outlet to guide a compressed refrigerant of the compressor to the outside of the hermetic casing; and an intake path to guide a refrigerant from external of the compressor to the refrigerant inlet.

16. The variable capacity rotary compressor according to claim 15, wherein the ring piston sucks the refrigerant of the refrigerant inlet, compresses the refrigerant and discharges the compressed refrigerant into the interior of the hermetic casing through the exhaust port, in response to the ring piston being eccentrically rotated in the compressing chamber along with the eccentric body part of the rotating shaft.

17. A variable capacity compressor, comprising:

a housing having a cylindrical compressing chamber defined therein;

a rotating shaft having an eccentric body part which rotates in the compressing chamber;

a ring piston which is fitted over the eccentric body part and rotates while being in contact with an inner surface of the compressing chamber;

a vane which is mounted in the housing and advances or retracts in a radial direction of the compressing chamber in accordance with a rotation of the ring piston; and a control unit which controls a moving range of the vane according to pressures of a refrigerant inlet and a refrigerant outlet of the compressor, so as to vary a refrigerant compressing capacity of the compressor, wherein the control unit includes:

a control cylinder having a control piston and mounted outside the housing, wherein the control piston is set in the control cylinder so as to advance and retract in the same direction as a moving direction of the vane;

a connecting member which connects the vane to the control piston so as to push or pull the vane in response to a movement of the control piston;

a first control path which communicates with an interior of the control cylinder;

a second control path which allows the first control path to communicate with the refrigerant outlet of the compressor;

a third control path which allows the first control path to communicate with the refrigerant inlet of the compressor; and a path control valve installed at a confluence of the first, second and third control paths.

18. A variable capacity compressor, comprising:

a housing having a cylindrical compressing chamber defined therein;

a rotating shaft having an eccentric body part which rotates in the compressing chamber;

a ring piston which is fitted over the eccentric body part and rotates while being in contact with an inner surface of the compressing chamber;

a vane which is mounted in the housing and advances or retracts in a radial direction of the compressing chamber in accordance with a rotation of the ring piston; and a control unit which selectively communicates with one of a refrigerant inlet and a refrigerant outlet of the compressor so as to change a moving range of the vane and control a refrigerant compressing capacity of the compressor, wherein the control unit includes:

a control cylinder having a control piston and mounted outside the housing, wherein the control piston is set in the control cylinder so as to advance and retract in the same direction as a moving direction of the vane;

a connecting member which connects the vane to the control piston so as to push or pull the vane in response to a movement of the control piston;

a first control path which communicates with an interior of the control cylinder;

a second control path which allows the first control path to communicate with the refrigerant outlet of the compressor;

a third control path which allows the first control path to communicate with the refrigerant inlet of the compressor; and a path control valve installed at a confluence of the first, second and third control paths.

* * * * *